US006176184B1

(12) United States Patent
Mudry

(10) Patent No.: US 6,176,184 B1
(45) Date of Patent: Jan. 23, 2001

(54) DRYER FOR FLEXOGRAPHIC AND GRAVURE PRINTING

(75) Inventor: Roman J. Mudry, Green Bay, WI (US)

(73) Assignee: Paper Converting Machine Company, Green Bay, WI (US)

( * ) Notice: Under 35 U.S.C. 154(b), the term of this patent shall be extended for 0 days.

(21) Appl. No.: 09/293,550

(22) Filed: Apr. 16, 1999

(51) Int. Cl.[7] ..... B41F 35/00
(52) U.S. Cl. ..... 101/424.1; 101/487
(58) Field of Search ..... 101/424.1, 416.1, 101/487, 488, 489; 219/381; 392/379

(56) References Cited

U.S. PATENT DOCUMENTS

| | | | | |
|---|---|---|---|---|
| Re. 36,083 | * | 2/1999 | Spiegel et al. | 101/148 |
| 1,479,819 | | 1/1924 | Kluever . | |
| 1,724,644 | | 8/1929 | De Long . | |
| 1,768,498 | | 6/1930 | Willsea . | |
| 1,955,055 | | 4/1934 | Date . | |
| 2,041,238 | | 5/1936 | Fickes . | |
| 2,298,803 | | 10/1942 | Morris . | |
| 2,420,739 | | 5/1947 | Dorsch . | |
| 2,578,633 | | 12/1951 | Mauffre . | |
| 2,627,667 | | 2/1953 | Gillis . | |
| 2,731,732 | | 1/1956 | Harris, Jr. et al. . | |
| 4,207,457 | | 6/1980 | Haglund et al. . | |
| 4,233,901 | | 11/1980 | Mallinson . | |
| 4,340,893 | | 7/1982 | Ort . | |
| 4,386,650 | | 6/1983 | Moen . | |
| 4,504,220 | | 3/1985 | Sunakawa et al. . | |
| 4,535,222 | | 8/1985 | Moen . | |
| 4,567,673 | | 2/1986 | Bohnensieker . | |
| 5,086,700 | | 2/1992 | Vam Den Berg . | |
| 5,113,931 | | 5/1992 | Oswalt et al. . | |
| 5,212,763 | | 5/1993 | Arold et al. . | |
| 5,303,325 | | 4/1994 | Pasternak et al. . | |
| 5,370,047 | | 12/1994 | Compton . | |
| 5,502,788 | | 3/1996 | Platsch . | |
| 5,765,294 | * | 6/1998 | Puschnerat | 34/381 |
| 5,881,647 | * | 3/1999 | Siler et al. | 101/488 |
| 5,937,761 | * | 8/1999 | Buschmann et al. | 101/424.1 |

* cited by examiner

*Primary Examiner*—John S. Hilten
*Assistant Examiner*—Darius N. Cone

(57) ABSTRACT

A dryer for a printing press uses an electric heater to heat air that flows into an air plenum. The heated air flows out of the plenum at high velocity through an array of orifices that have a diameter of about 0.040 inch. The high velocity air impinges on ink which is printed on a web by the press.

6 Claims, 8 Drawing Sheets

DRYER FOR FLEXOGRAPHIC AND GRAVURE PRINTING

BACKGROUND

This invention relates to dryers, and, more particularly, to a dryer for solvent based or water based inks and coatings which are applied to continuous webs by flexographic or gravure presses.

Present dryers for flexographic and gravure presses use hot air, sometimes with the assistance of infrared radiation, which impinges a moving freshly printed web. The temperature of the hot air is typically controlled so as not to exceed temperatures where the print, coating, or web may be compromised, including skinning of print or coating, boiling of print or coatings, or thermal yielding of film webs.

In general, traditional forced hot air drying systems used on flexographic and gravure printing and coating equipment have used slotted air impinging nozzle dryers. By impinging it is meant that the direction of the air stream flow has a predominant perpendicular velocity component relative to the local planar surface of the web being impinged upon by the air stream. The nozzle slot width on these systems has typically been in the range of 0.040 to 0.125 inch and with a nozzle slot length of the maximum web width plus or minus approximately 1 to 1½ inch based on a particular application. The internal nozzle chamber pressures have typically been in the range of 5 to 15 inches water column (1 psi=27.76 inches water column) which produces the driving force to achieve impinging air flow velocities in the range of 5,000 to 12,000 feet per minute. The drying capacity of the system is dominated by the heat transfer characteristics in the locale of the impinging air stream. The heat transfer coefficient is strongly related to the impinging air stream velocity. Improving the performance of the traditional air impinging nozzle dryer technology is currently limited by technological, economical, and space limitations of the mechanics for which these systems are integrated.

Variations of the slotted nozzle arrangement include a distributed orifice array with orifice diameters of approximately 0.125 inch. Some dryer manufactures claim that such orifice arrays have improved evaporative drying performance. This particular type of configuration uses pressure supplies similar to the slotted nozzles described above.

SUMMARY OF THE INVENTION

The invention provides a dryer that delivers impinging air through an array of orifices that are approximately 0.040 inch in diameter. The air is heated by a dedicated heat plant that is controlled by a dedicated control circuit. The preferred embodiment of the heat plant is a coiled wire heating element which is positioned in the path of the air flow.

DESCRIPTION OF THE DRAWING

The invention will be explained in conjunction with illustrative embodiments shown in the accompanying drawing, in which.

DESCRIPTION OF SPECIFIC EMBODIMENTS

Figure 1:
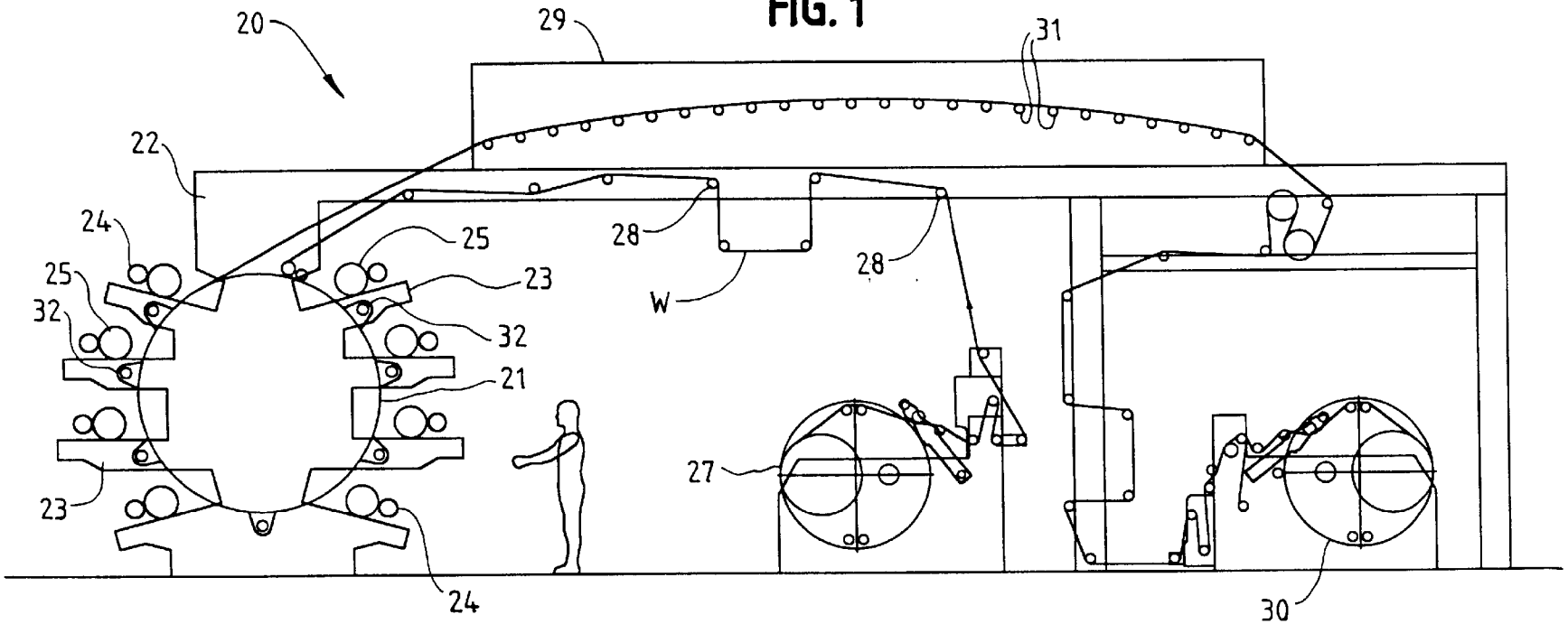
FIG. 1 is a schematic illustration of the central impression drum of a flexographic press with eight color decks, between color dryers, and a tunnel dryer.

Referring to FIG. 1, a flexographic press 20 includes a central impression drum 21 that is rotatably mounted on a pair of side frames 22. The particular press illustrated in FIG. 1 includes eight color decks 23 that are mounted on the frames. Each color deck includes an anilox roll 24 and a plate cylinder 25 for applying ink to a web W that rotates with the central impression drum.

The web is unwound from an unwinder 27 and passes over rollers 28 to the central impression drum 21. The web rotates with the central impression drum and then passes through a tunnel dryer 29 to a rewinder 30. Rollers 31 support the web inside of the tunnel dryer. A single between color dryer 32 is mounted on the side frames 22 downstream of each of the first seven color decks 23 for drying the ink which is applied to the web by the individual plate cylinders 25. A tunnel dryer is mounted on an independent structure downstream of the eighth deck.

With the exception of the particular structure and operation of the between color dryers and the tunnel dryer which will be described hereinafter, the flexographic press illustrated in FIG. 1 is conventional and well known.

Figure 2:
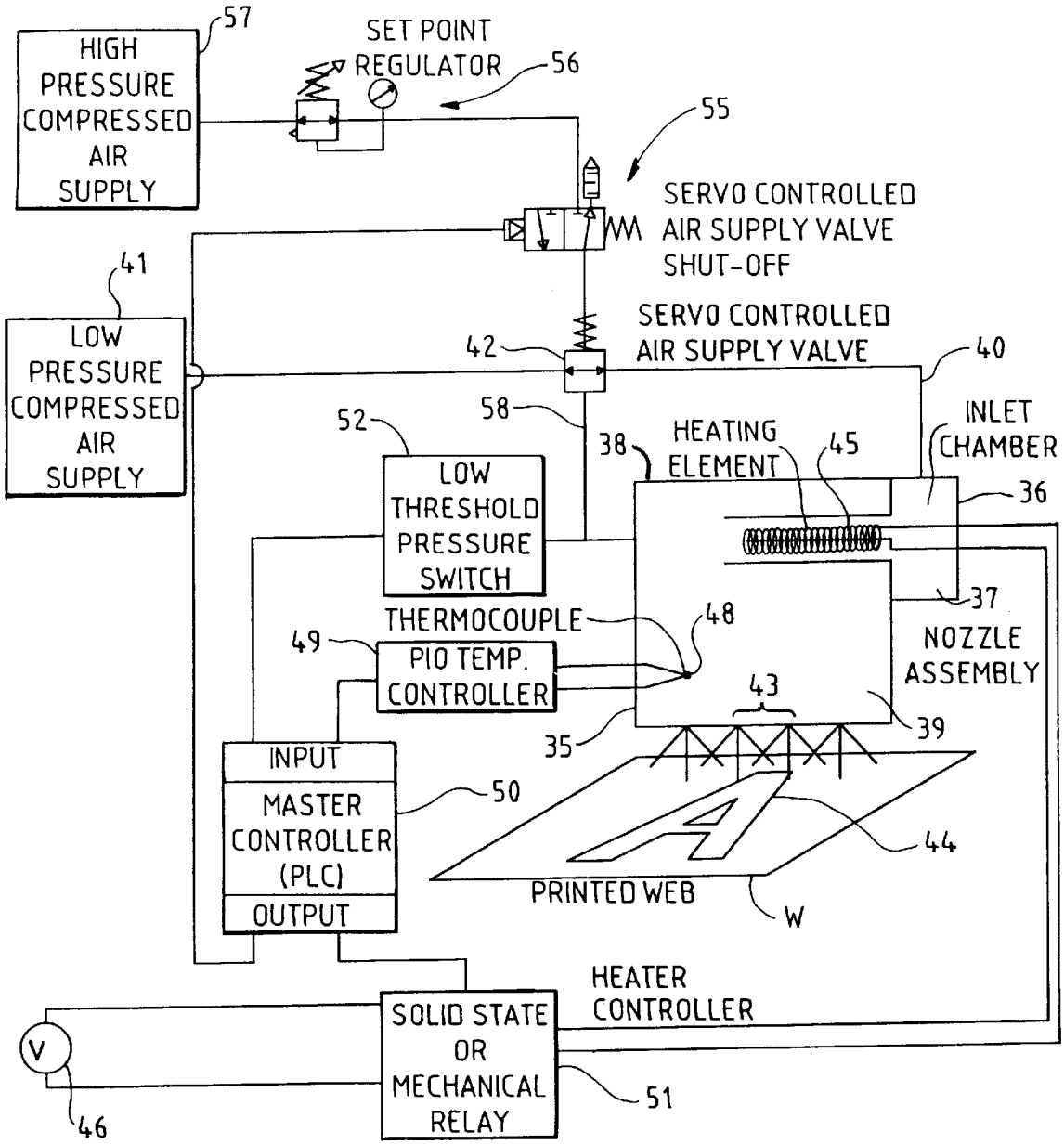
FIG. 2 is a schematic illustration of a between color dryer and a control system which is formed in accordance with the invention.
Figure 3:
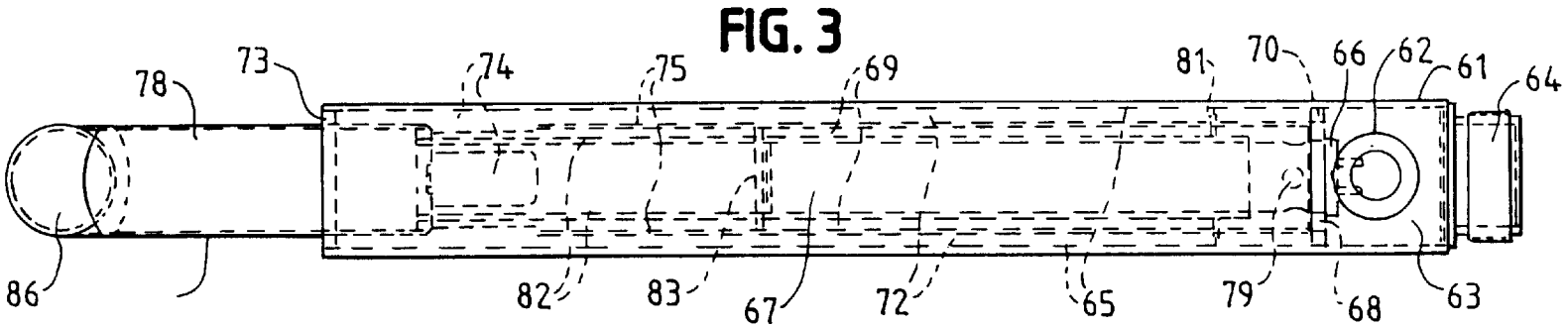
FIG. 3 is a top plan view of the triple pass heat plant that is a common to the various dryer configurations and is formed in accordance with the invention.
Figure 4:
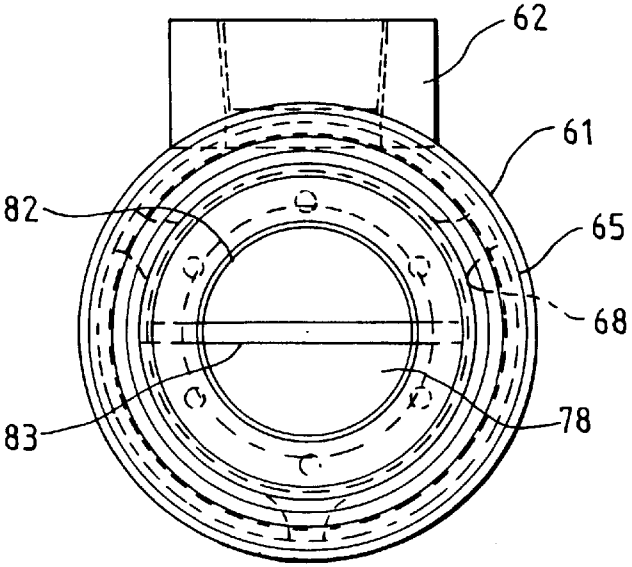
FIG. 4 is an end view of the triple pass heat plant of FIG. 3.
Figure 5:
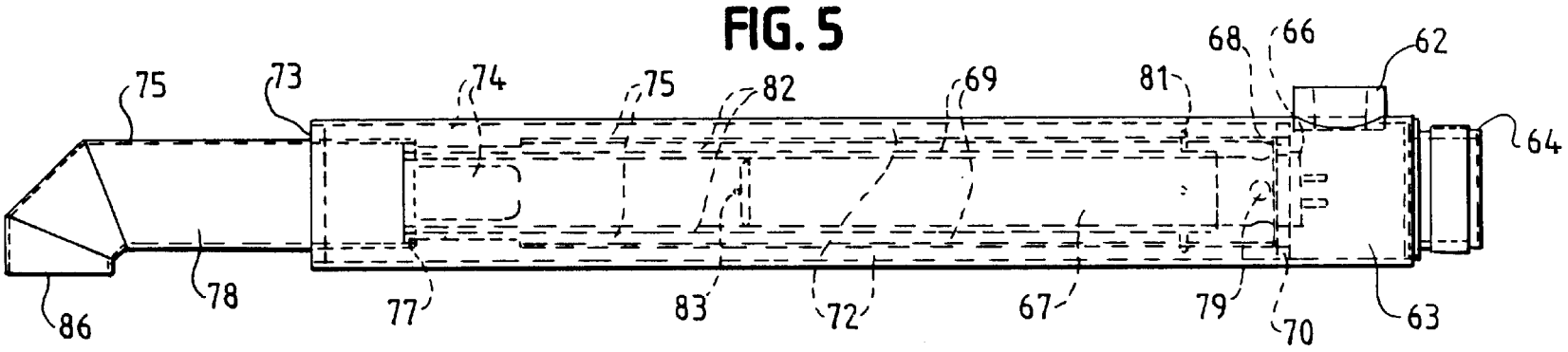
FIG. 5 is a side view of the triple pass heat plant of FIG. 3.
Figure 6:
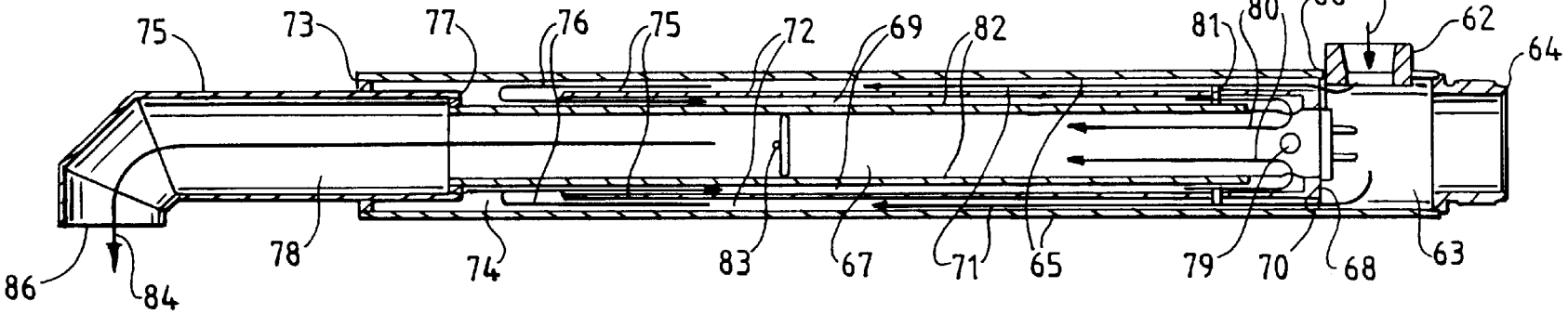
FIG. 6 is a sectional side view of the triple pass heat plant of FIG. 3.

FIG. 2 illustrates a dryer 35 which includes a first casing 36 which provides an inlet chamber 37 and a second casing 38 which provides a nozzle plenum 39. Compressed air is provided to the inlet chamber 37 by an air inlet tube 40 that is ultimately connected to a low-pressure air supply 41. The low-pressure compressed air preferably has a maximum pressure of 50 psi. (In contrast, high-pressure compressed air typically has a minimum pressure of 80 psig.) A servo controlled air supply valve 42 (SCASV) is located along air inlet tube 40 to regulate the volume of air entering the inlet chamber 37.

The casing 38 is provided with a plurality of round orifices 43 that preferably have a diameter of 0.040 inch or less. Air flows through the orifices at near sonic velocity (67,500 ft/min). Upon exiting the orifice, the air, now traveling at a considerably reduced velocity, impinges on ink 44 which is imprinted on the web W which is supported by the central impression drum 21.

A heating element 45 is positioned in the path of the pressurized air for heating the stream of air. The heating element is an electrical resistance heater that is ultimately powered by a voltage source 46. The heater can be heated by power sources that are available to typical light industry, for example, 120-volt alternating current (AC) or 240-volt AC.

In one specific embodiment the heating element 45 was a commercially available heating element composed of a wound wire consisting of an iron based alloy sold under the trademark Kanthal Al. This alloy is 5.5% aluminum, 22% chromium, 0.5% cobalt, and 62% iron. Kanthal Al has a melting point of 2750° F., and an electric resistivity of 145 microohms-cm. The wire is helically or spirally wound into a coil to form the heating element and the air that flows through the inlet chamber 37 flows through and around the heating element. This type of heater element is well described in U.S. Pat. No. 4,207,457. Other types of wires and other forms of heaters can also be used.

A temperature sensor 48, such as a thermocouple, senses the temperature of the heated air within the nozzle plenum 39 and provides feedback to a proportional integral derivative (PID) temperature controller 49. The temperature controller provides input to a master controller 50, which also provides output that subsequently, operates a heater controller 51. The heater controller 51 can be a solid state relay, mechanical relay or other voltage or electric current regulating device. Depending upon the temperature within the nozzle plenum 38, the heater controller 51 connects, disconnects, or regulates the electrical power to the heating element 45. A low-threshold pressure-switch 52 senses whether there is air pressure, and thus air flow within the plenum, before the heater is energized.

The air pressure in the nozzle plenum 38 is controlled by a pneumatic servo valve mechanism within the SCASV 42. The SCASV is sometimes referred to as a volume-booster or as an externally sensed dome-loaded regulator.

A set point pressure regulator 56 regulates the high-pressure compressed air supply 57, thus establishing the set point pressure, or reference pressure, side of the SCASV 42. Pressure from the plenum is fed back through feedback pressure airline 58 to the opposite side of the SCASV 42. The difference in pressure on the two sides of the servo-mechanism within the SCASV 42 shuttles the valve mechanism within the SCASV 42 to sustain the desired pressure in the nozzle plenum 39.

The pressure output from the set point regulator is presented to the dome of the SCASV 42, by the servo controlled air supply valve shut-off 55 (SCASVSO). The SCASVSO 55 is an electrically controlled pneumatic valve that passes, or shuts off, the set-point pressure to the dome of the SCASV 42. This feature allows the set-point pressure of the dryer to be preset, and thus facilitates a simple electrical means of starting or stopping flow in the dryer 35.

A further benefit of this invention is the ability to locate the set-point regulator 56 remotely, thus allowing the efficient adjustment and inspection of the individual dryer systems. Another improvement of this configuration is the ability of a single set-point regulator to control the pressure to a plurality of nozzle plenums simultaneously to a common set-point pressure.

FIGS. 3–6 illustrate several views of a triple pass heater that is common to both specific dryer configurations described hereinafter.

A triple pass heater 61, is a labyrinthine cylindrically constructed device that heats the incoming air stream 60 prior to delivery of the air to the distribution plenums. The air stream initially enters the triple pass heater 61 through an air inlet port 62 into the air inlet chamber 63. An electrical receptacle (not shown) inserted into the electrical receptacle port 64, and the outer casing 65 provide the barrier between the air inlet chamber 63 and the outside environment. The mating surfaces between the heating element flange 66 of the heating element 67, and the primary header 68 provide the barrier between the air inlet chamber 63 and the intermediate chamber 69.

The primary header slots 70 fashioned in the primary header 68 provide for air flow paths 71 from the air inlet chamber 63 to the exterior chamber 72. The outer casing 65 and the outer header 73 provide the barrier between the exterior chamber 72 and the outside environment.

The intermediate casing slots 74 in the intermediate casing 75 provide for air flow paths 76 from the exterior chamber 72 to the intermediate chamber 69. The intermediate casing 75 and the inner header 77 provide the barrier between the exterior chamber 72 and the inner chamber 78.

Heating element holes 79 in the outer shell of the heating element 67 provide the means for air flow paths 80 from the intermediate chamber 69 into the internal passage of the heating element 67. Pins 81 provide the structural means of supporting the inner casing 82 concentrically inside the intermediate casing 75.

The mating surface between outer shell of the heat element 67 and the inner casing 82 insure that the air does not pass along the outer surface of the heating element. Pin 83 provides a redundant device for preventing heating element 67 from falling into the triple pass heater 61 in the event the heating element flange 66 would separate from the heating element 67.

Upon exiting the heating element 67, the exiting air flow 84 is in a heated state and is channeled by the intermediate casing 75 to the triple pass exit port 86.

In this particular embodiment, the intermediate casing 75 is fashioned into an elbow-type construction to impart a bend in the exiting air flow 84. The design variations to this particular feature of the intermediate casing 75 are unlimited as required by the specific application of the triple pass heater 61.

Figure 7:
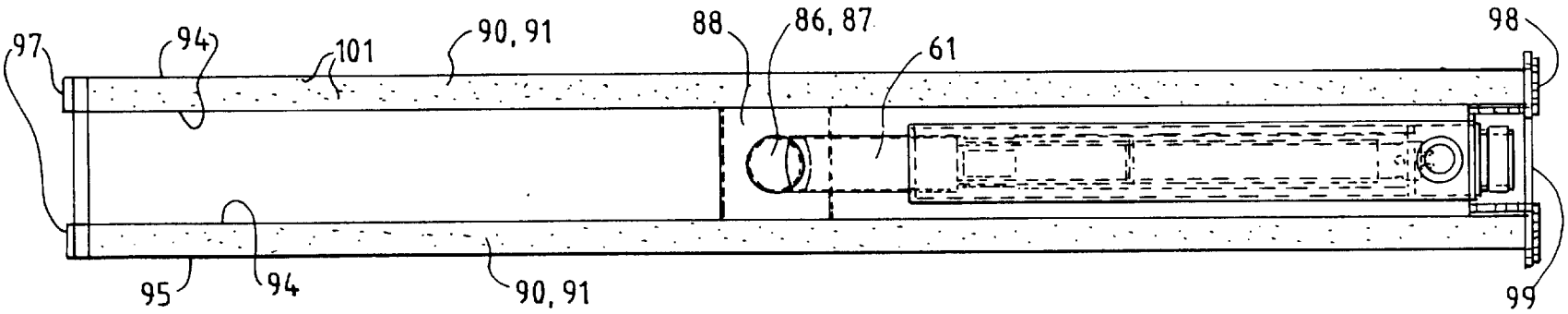
FIG. 7 is a top plan view of a between color dryer that is formed in accordance with the invention.
Figure 8:
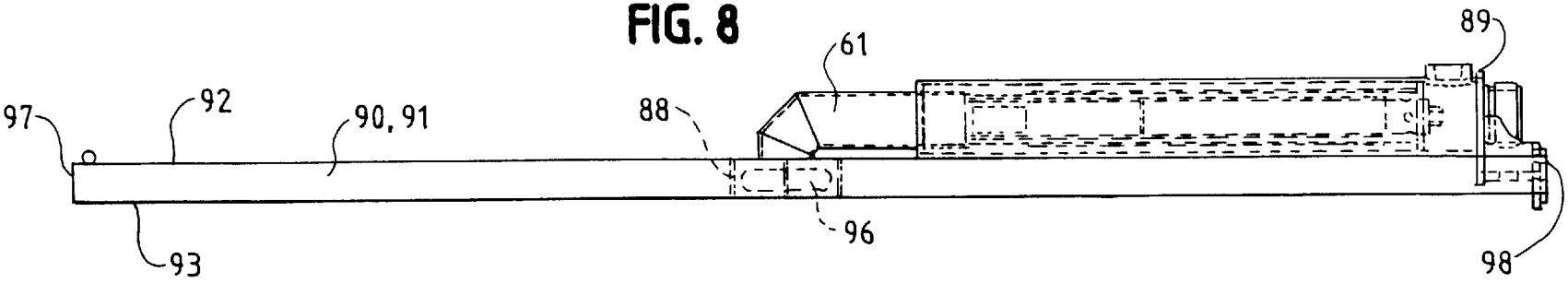
FIG. 8 is a side view of the dryer of FIG. 7.
Figure 9:
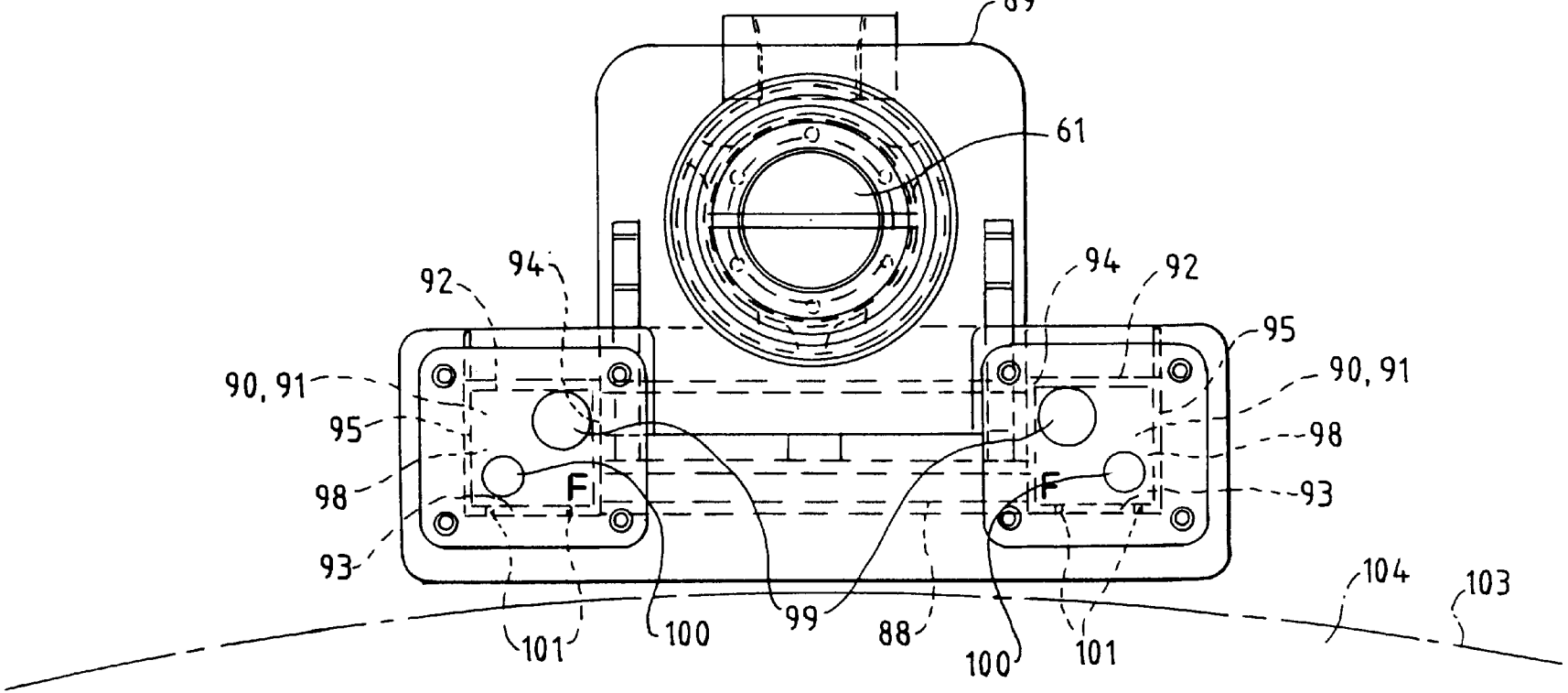
FIG. 9 is an end view of the dryer of FIG. 7.

The details of a specific embodiment of a between color dryer are illustrated in FIGS. 7–9. The triple pass heater 61 described earlier is attached to the central air feeder 88 of the between color dryer assembly 89. The triple pass exit port 86 mates directly to a central air feeder inlet port 87. Air exiting the triple pass heater 61 flows into the central air feeder 88, splits and is directed outwardly towards two nozzle plenums 90.

The nozzle plenums 90 are constructed of independent bottom casings 91 that are spaced apart in a direction which extends transversely to the longitudinal centerline of the dryer and parallel to the direction in which the web 103 is advanced past the between color dryer assembly 89. Each of the bottom casings 91 includes top and bottom walls 92 and 93 and inner and outer side walls 94 and 95. End plates 97 seal the back end of the nozzle plenums 90. End plates 98 seal the front ends of the nozzle plenums 90. End plates 98 also provide ports 99 and 100 for thermocouple (not shown) and pressure feedback (not shown).

Air flow from the central air feeder 88 passes through the nozzle plenum slot 96 provided in the inner side wall 94 of each nozzle plenum 90. A plurality of orifices 101 are provided in each of the bottom walls 93 of the nozzle plenums 90. The orifices preferably have a diameter of 0.040 inch or less.

Specifically for the between color dryer configuration where the preprinted web 103 is fully supported by a central impression drum 104 or other relatively flat solid or porous surface, the orifices 101 can be distributed such that they maximize the impingement area of the orifices. In this case, each nozzle plenum 90 has two transversely oriented rows of evenly spaced orifices. In the longitudinal direction, the orifices are staggered between all four rows such that no two orifices lie on the same longitudinal line. This design practice generally maximizes the evaporative drying performance of the dryer.

The number of orifices is dependent on the power capacity of the heating element, the intended operating pressure and thus air consumption of the dryer, and the intended maximum operating temperature of the dryer.

Figure 10:
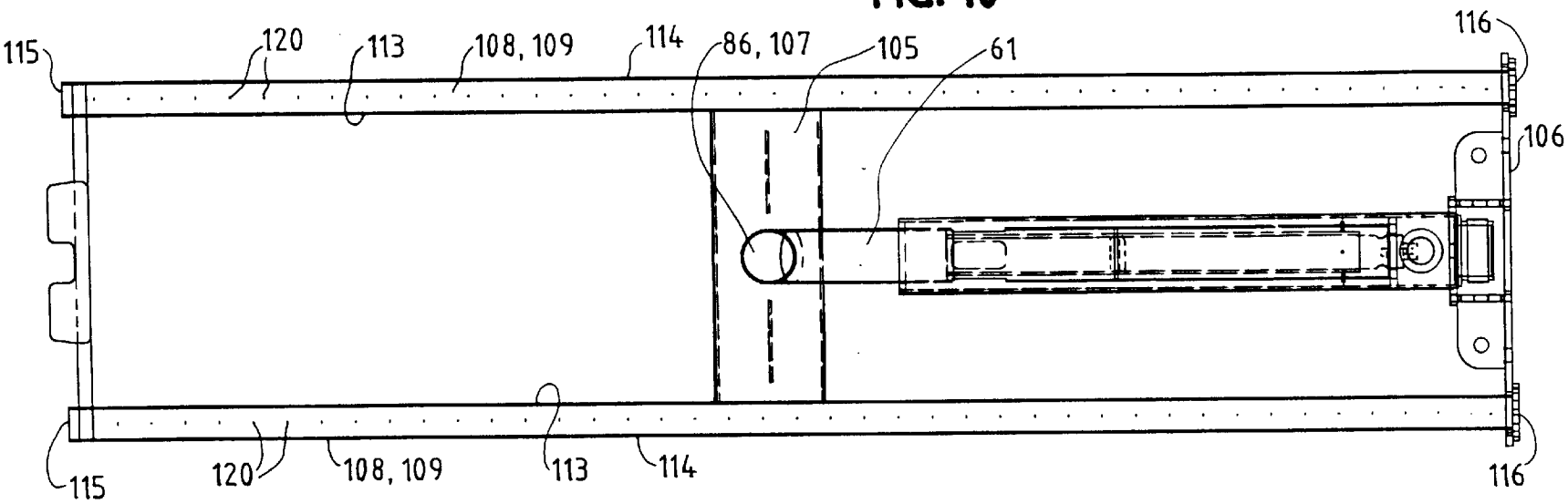
FIG. 10 is a top view of a tunnel dryer that is formed in accordance with the invention.
Figure 11:
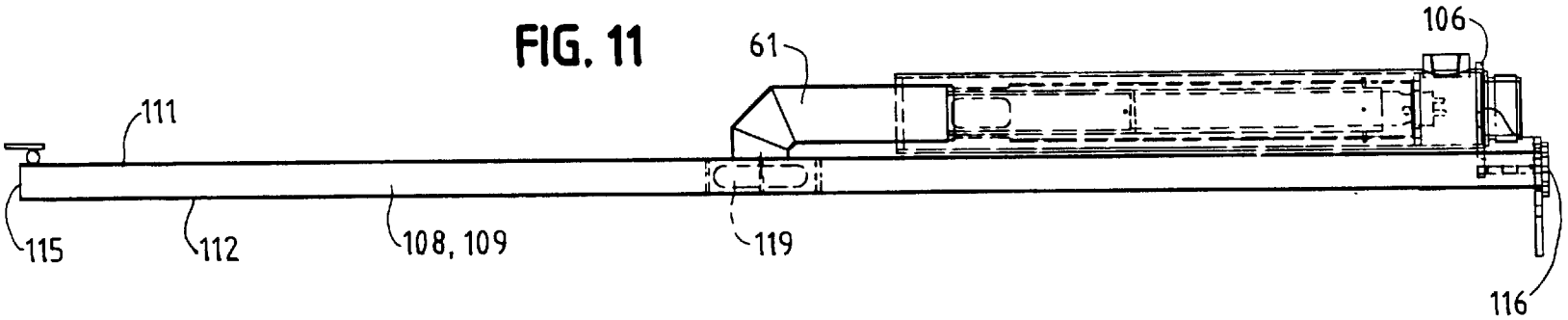
FIG. 11 is a side view of the dryer of FIG. 10.
Figure 12:
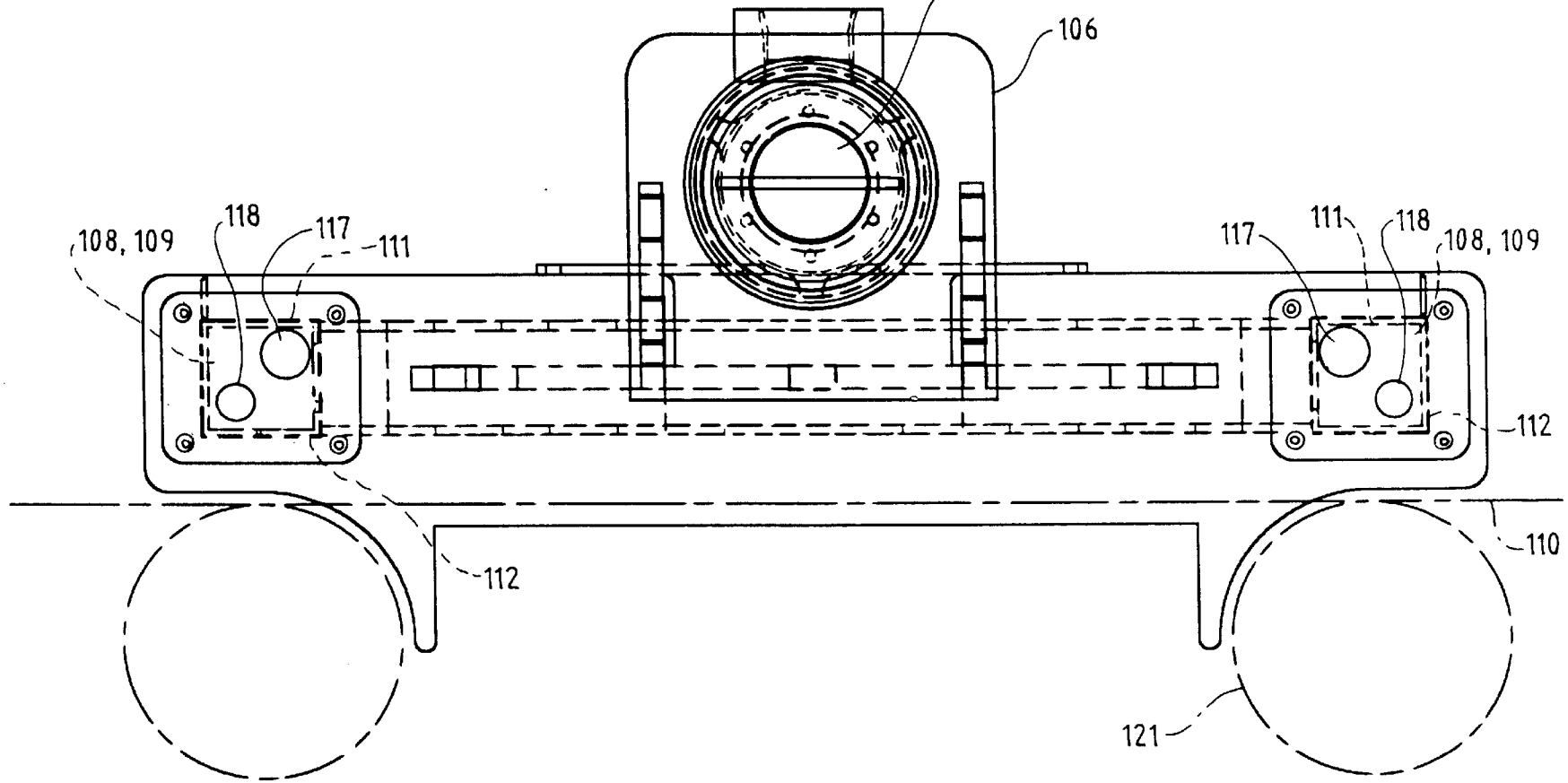
FIG. 12 is an end view of the dryer of FIG. 10.

The details of a specific embodiment of a tunnel dryer are illustrated in FIGS. 10–12. The triple pass heater 61 described earlier is attached to the central air feeder 105 of the tunnel dryer assembly 106. The triple pass exit port 86 mates directly to a central air feeder inlet port 107. Air exiting the triple pass heater 61 flows into the central air feeder 105, splits and is directed outwardly towards two nozzle plenums 108.

The nozzle plenums 108 are constructed of independent bottom casings 109 that are spaced apart in a direction which extends transversely to the longitudinal centerline of the dryer and parallel to the direction in which the web 110 is advanced past the tunnel dryer assembly 106. Each of the bottom casings 109 includes top and bottom walls 111 and 112 and inner and outer side walls 113 and 114. End plates 115 seal the back end of the nozzle plenums 108. End plates 116 seal the front ends of the nozzle plenums 108. End plates 116 also provide ports 117 and 118 for thermocouple (not shown) and pressure feedback (not shown).

Air flow from the central air feeder 105 passes through the nozzle plenum slot 119 provided in the inner side wall 113 of each nozzle plenum 108. A plurality of orifices 120 are provided in each of the bottom walls 112 of the nozzle plenums 108. The orifices preferably have a diameter of 0.040 inch or less.

Specifically for the tunnel dryer configuration where the preprinted web 110 is marginally supported by a tunnel roll 121 or other highly curved solid or porous surface, the orifices 121 are arranged transversely and directly above the contact line between the tunnel roll 121 and web 110. This arrangement is preferred in this case in order to maximize the support of the web directly under the impinging air flow exiting the nozzle plenums 108. Had the orifices been distributed similarly to the between color dryer, disturbances induced into the web by the impinging air flow can have detrimental affect to the quality of the printed web.

In the longitudinal direction, the orifices are staggered between the two rows such that no two orifices lie on the same longitudinal line. This design practice generally maximizes the evaporative drying and web handling performance of the tunnel dryer.

The number of orifices is dependent on the power capacity of the heating element, the intended operating pressure and thus air consumption of the dryer, and the intended maximum operating temperature of the dryer.

The foregoing dryer system includes the following features:

1. The delivered impinging air streams will be provided through an array of orifices each being approximately 0.040 inch diameter. The spacing of the orifices, both laterally and longitudinally, in the array will be determined by the particular dryer application, including web width, web dwell time, and distance from web.

2. A single bank of orifices will be serviced by a dedicated heat plant and will be "closed loop controlled" with a dedicated control circuit. The control circuit can utilize one or both schemes of controlling plenum pressure (and thus flow) or controlling air temperature. In the case of a single controlled loop, the heat plant would be operated continuously or the air system would be operated continuously respectively.

3. The location of this heat plant in the extreme locale of the solvent laden air might prevent this device and configuration from being used with hazardous/flammable solvent vapors. With non-hazardous solvent, such as water, this configuration appears to be very well-suited. However, investigation into the regulatory constraints may show that this device may be very applicable in the flammable environments as well. Given that solvent-free pressurized air is used as the heat transfer medium, the internal chamber of the heating plant falls under the definition of being a purged enclosure and can therefore reside in a solvent laden environment. Experimental verification will be necessary to confirm that the heating plants shell does not attain a surface temperature equal to greater than the Auto-ignition Temperature (AIT) under normal operating conditions.

The AIT of the most common solvents used in flexographic and gravure printing inks and coatings are: Acetone—869° F.; Ethyl Acetate—800° F.; Isopropyl Acetate—860° F.; Methyl Ethyl Ketone—759° F.; 1-propanol—775° F.; 2-propanol—750° F.; n-propyl Acetate—842° F.; Toluene—896° F.; Xylene—867° F.

The high temperature (greater than 1950° F.) element is located in a clean air stream, and is separated by use of a labyrinth jacket which directs the sub-auto-ignition temperature air supply stream to the outside of the heating plant layer. The outside surface of the heat plant is therefore at a substantially lower temperature than the heated air stream temperature and can be controlled to be less than 350° F.

4. The heat plant will be attached directly to the air delivery nozzle. The heat plant is energized through electrical means. A further benefit of this invention is the elimination of an added heat load to the environment in which the equipment is installed by eliminating large supply plenums conveying the heated air. This invention thereby minimized energies required to maintain controlled temperatures in that environment. The invention also minimizes the dwell time between effecting the temperature and sensing the temperature change, thereby improving response time of the system.

5. A temperature sensor, of a thermocouple type design, will be used to provide feedback for the air temperature within the air delivery plenum. The sensor is preferably situated at a distance furthest from the heating element.

6. The remote location of the temperature control module allows the efficient adjustment and inspection of the individual dryer systems. A further improvement of this configuration is the use of a single control module which is capable of controlling multiple temperature controlled systems to independent temperatures.

7. The expected standard air supply volume consumption (calculated at 70 deg F and a standard pressure of 1 atmosphere) is expected to be in the range of 1 to 1.6 cubic feet per minute per inch of dryer length in the cross machine direction. Compared to a conventionally configured slotted nozzle dryer (with a double slot each with median nozzle slot width of 0.082 inches, and a median impinging air flow velocity of 8,500 feet per minute) a typical dryer system consumes 9.74 cubic feet of air per minute per inch of dryer length in the cross machine direction. The reduced air supply volume will provide energy savings when compared with a non-recirculating dryer system utilizing traditional slotted nozzle dryers.

Given the fact that infiltration air volumes are typically an additional 50% of nozzle delivery, another benefit of the reduced air delivery volume is a reduction of infiltration air volumes required to maintain negative pressures inside the dryer enclosures. The reduction of infiltration volume will minimize the effects of air moving past plate cylinders and anilox rolls, which contributes to ink drying on the plates and in the anilox cells. By reducing the impact of drying the inks prematurely on those components, inks with higher solids contents and improved color densities become viable alternatives, thereby improving the entire printing process.

A further benefit of the reduced air delivery volume is the potential of reduced exhaust air. Make up air is automatically throttled to insure optimal solvent vapor concentrations in the exhaust air which is conveyed to incinerator systems, thereby reducing the size and energy consumption of the incinerator system(s).

8. Actual ink and coating drying performance is improved because of the dramatic increase of impinging air stream velocities and the resulting improvement of the heat transfer and evaporative mass transfer characteristics. The energy or heat content of the dryer air stream will be transferred more efficiently to the ink system and subsequently infused as the energy required for vaporization, frequently referred to as the latent heat of vaporization.

9. The audible noise generated by the discharging air stream in the demonstrated nozzle is dramatically decreased. The further elimination of large air supply duct-work typical of current systems will further diminish noise-generating bodies. A marked reduction in the exhaust air stream volume and velocity will provide a similar benefit.

10. Overall, the system will result in a significant reduction of physical mechanical equipment mounted onto the actual machine line. This characteristic can have a major influence on opening up the available space between color decks. The elimination of the traditional heating systems mounted in the overhead will reduce the overall headroom requirement of the equipment in any given installation.

11. The compressed air supply equipment (compressors, dryers, filters) can be located a significant distance away (up to several hundred feet) from the printing equipment to eliminate noise generated by the equipment.

12. A benefit of the air compressor system is that heat developed in the compression cycle can be used to generate heat for the heating of the buildings in the cold season by passing the cooling air stream for the compressor directly into the building or through a heat exchanger. The heat exchanger can impart additional heat into the compressed air stream, thereby reducing the power required to raise the air temperature within each independent dryer.

13. By adjusting the dryer parameters of each module individually, there is a high likelihood that the net energy requirements will be reduced for print jobs with low ink and/or coating coverage.

14. The dryer modules can be further developed to add incremental dryer length to a tunnel dryer for special drying applications. This is a natural evolution of the invention into a modular approach, providing marketing advantage for making available added dryer length in an "as needed", or future, basis.

15. The compactness of the design and the resulting accelerated air exchange process in the internal dryer chambers allows for a reduction of purge cycles, thereby reducing the machine start-up cycle. This will also result in significant economies when the presses are temporarily stopped for intermittent service to the printing press. The invention allows for the dryer system to be completely shut off during these periods, thereby saving energy costs.

16. By eliminating gas as the heat source and eliminating an air recirculation system, the need for Lower Flammable Limit (also called Lower Explosive Limits) monitoring equipment in the supply stream is also eliminated. Further savings may be realized by a simplification of certification within industry insurance agencies such as FM insurance by eliminating the need for supplying natural gas, or similar, to the machine line installation.

The particularly novel features of the invention can be summarized as:

1. The use of lower air volumes at higher pressure to attain higher impingement velocities and thus higher heat transfer and mass transfer characteristics for improved drying performance.

2. Compact design of an integrated system to provide improved dryer control of discrete dryer length segments of an entire dryer length.

3. Compact design of an integrated system allowing a modular approach to dryer systems.

4. Unique method of air handling resulting in lower audible noise and a reduction of real-estate for associated air handling equipment.

While in the foregoing specification a detailed description of specific embodiments was set forth for the purpose of illustration, it will be understood that many of the details herein given can be varied considerably by those skilled in the art without departing from the spirit and scope of the invention.

I claim:

1. A dryer for drying ink applied to a web by a printing press comprising:

a casing having an air plenum and a plurality of orifices for communicating the air plenum with the exterior of the casing. the casing being adapted to be mounted with the orifices adjacent the web, a source of pressurized air, an air passage for conveying pressurized air from the source of pressurized air to the air plenum, an electric heater positioned in said air passage for heating the air as it moves from the source of pressurized air to the air plenum, and controlling means for controlling the pressure of the air in the plenum, the controlling means including an externally sensed dome loaded regulator having a set point side and an opposite side, a set point regulator connected to the set point side of the dome loaded regulator, the air plenum being connected to the opposite side of the dome loaded regulator.

2. A dryer for drying ink applied to a web by a printing press comprising:

a first casing having an air inlet and an air outlet, interior walls mounted inside the first casing and forming a labyrinthine air passage inside the first casing between the air inlet and the air outlet an electric heater mounted in said labyrinthine passage for heating air which flows from the air inlet to the air outlet, and a second casing having an air inlet which is connected to the air outlet of the first casing, an air plenum, and a plurality of outlet orifices for allowing air to pass from the plenum to the exterior of the second casing.

3. The dryer of claim 2 in which said second casing is provided with a pair of elongated, parallel, spaced-apart plenums, each of said plenums having a plurality of outlet orifices.

4. The dryer of claim 3 in which said orifices have a diameter of about 0.040 inch.

5. The dryer of claim 2 in which said orifices have a diameter of about 0.040 inch.

6. The dryer of claim 2 in which said heater comprises a helically wound wire.

* * * * *